US005533456A

United States Patent [19]

Regina

[11] Patent Number: 5,533,456

[45] Date of Patent: Jul. 9, 1996

[54] RACK BASE CONSTRUCTION AND METHOD OF MANUFACTURE

[75] Inventor: Michael E. Regina, Vestaburg, Mich.

[73] Assignee: The Lobdell-Emery Manufacturing Company, Alma, Mich.

[21] Appl. No.: 237,698

[22] Filed: May 4, 1994

[51] Int. Cl.[6] ..... B65D 19/00

[52] U.S. Cl. ..... 108/51.1; 108/55.1; 211/153; 211/183

[58] Field of Search ..... 211/183, 153; 248/346; 108/51.1, 55.1, 55.5

[56] References Cited

U.S. PATENT DOCUMENTS

| | | | |
|---|---|---|---|
| 3,602,157 | 8/1971 | Coben | 108/51.1 |
| 3,699,902 | 10/1972 | Allgeyer et al. | 108/51.1 |
| 3,776,146 | 12/1973 | Morrison | 108/51.1 |
| 3,826,205 | 7/1974 | Weiss | 108/51.1 |
| 3,857,494 | 12/1974 | Giardini | 108/55.1 |
| 4,485,744 | 12/1984 | Umemura et al. | 108/51.1 |
| 5,069,143 | 12/1991 | Bunger | 108/51.1 |
| 5,101,737 | 4/1992 | Gomez | 108/51.1 |
| 5,111,950 | 5/1992 | Wylenzek | 220/1.5 |
| 5,211,117 | 5/1993 | Beamer | 108/51.1 |

FOREIGN PATENT DOCUMENTS

| | | | |
|---|---|---|---|
| 7707807 | 1/1978 | Netherlands | 108/51.1 |

*Primary Examiner*—Ramon O. Ramirez
*Assistant Examiner*—Anita King
*Attorney, Agent, or Firm*—Learman & McCulloch

[57] ABSTRACT

A base for use in supporting workpieces and which may be transported from place to place by a forklift truck comprises two pairs of tunnel-forming limbs arranged in tic-tac-toe form and open at their opposite ends to enable the forks of a forklift truck to enter the base from any one of four different directions. The tunnel-forming limbs are constructed from a pair of overlying workpieces having flat surfaces from which right angular flanges extend. The two workpieces are arranged so that their flanges overlie and confront one another, and the flanges are joined together to form the base.

19 Claims, 3 Drawing Sheets

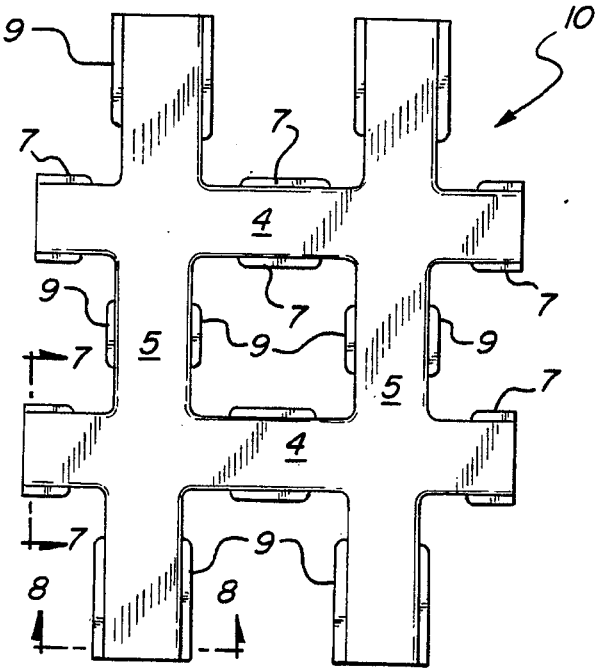
FIG-6
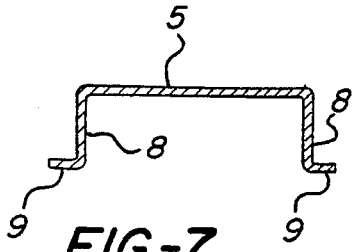
FIG-7
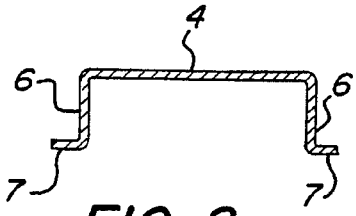
FIG-8
FIG-9
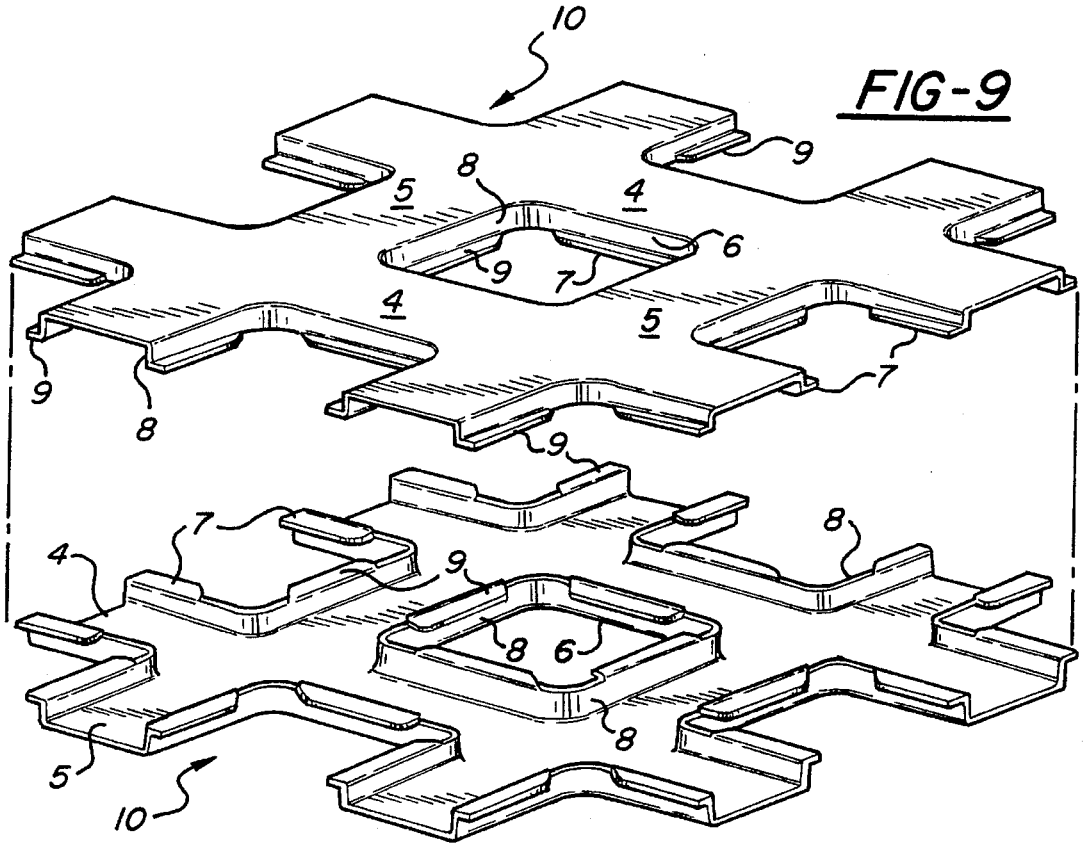

11
1
12
8
6
9
13
17
14
8
7
7
19
15
9
16
18

20
26
27
27
26
26
24
26
23
27
28
25
21
25
25
22
25
28
28

RACK BASE CONSTRUCTION AND METHOD OF MANUFACTURE

This invention relates to the construction of a base for an industrial rack of the kind that is adapted to support various kinds of workpieces for movement by forklift trucks from one place to another.

BACKGROUND OF THE INVENTION

It is conventional to provide forkliftable workpiece supporting racks of the kind having a base fitted with a superstructure that is especially equipped to provide support for workpieces during various stages of manufacture or treatment of such workpieces. Conventionally, the superstructure is secured to and upstands from a base having two pairs of tubular limbs which enable the base and whatever is supported thereon to be engaged and lifted by a forklift truck. The tubular limbs conventionally are so arranged that the forks of a forklift truck may enter the base from any one of four different directions.

In the manufacture heretofore of rack bases of the kind referred to it has been customary to roll or bend a steel sheet into a four-sided tube which is welded to produce a hollow limb. A plurality of such limbs then are cut to produce shorter tubes. Some of the tubes then are cut to form openings therein, and the several tubes then are welded to one another so that a base is formed having two pairs of intersecting tubes, the tubes of each pair forming tunnels and being spaced from one another a distance sufficient to accommodate easily the forks of a forklift truck.

The conventional manner of forming such rack bases is extremely labor intensive and slow because of the many operations that must be performed to produce an acceptable base. Consequently, the cost of racks utilizing bases formed in the conventional manner is expensive.

An object of the present invention is to provide a construction for a rack base which is as strong as, or stronger, than bases produced in the conventional manner, and which overcomes the disadvantages of the known construction.

SUMMARY OF THE INVENTION

A forkliftable rack base constructed in accordance with the preferred embodiment of the invention comprises two overlying frame members or workpieces each of which has been formed from a single, flat metal blank and each of which has two pairs of spaced apart, parallel members, the pairs of members extending at right angles to one another, and each of the blanks having confronting edges which, when welded together, form a tic-tac-toe shaped member having unobstructed tubular limbs, thereby enabling the forks of a forklift truck to be accommodated in the base from any one of four different directions.

THE DRAWINGS

Figure 3:
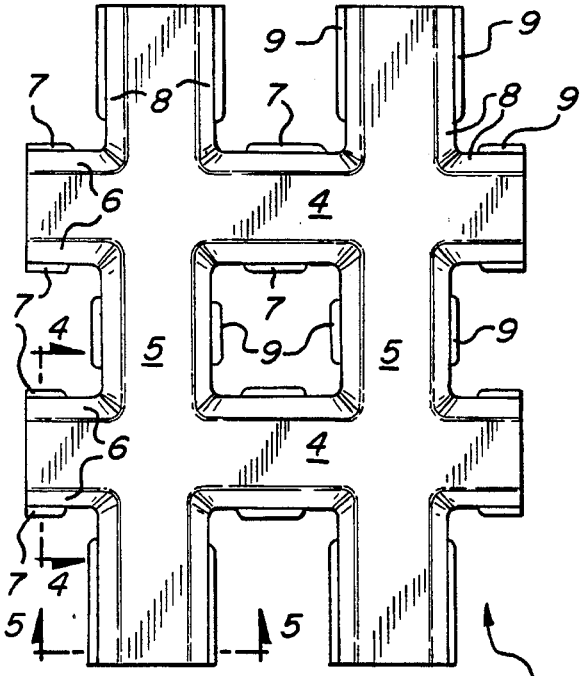
FIG. 3 is a plan view showing a partial formation of the blank into one of the two workpieces from which the base is formed.
Figure 4:
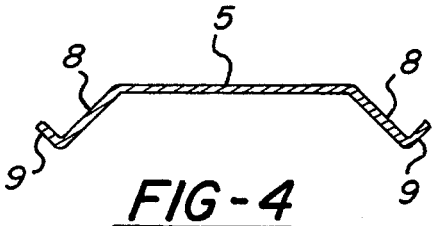
Figure 5:
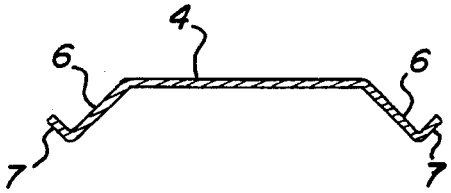
Figure 10:
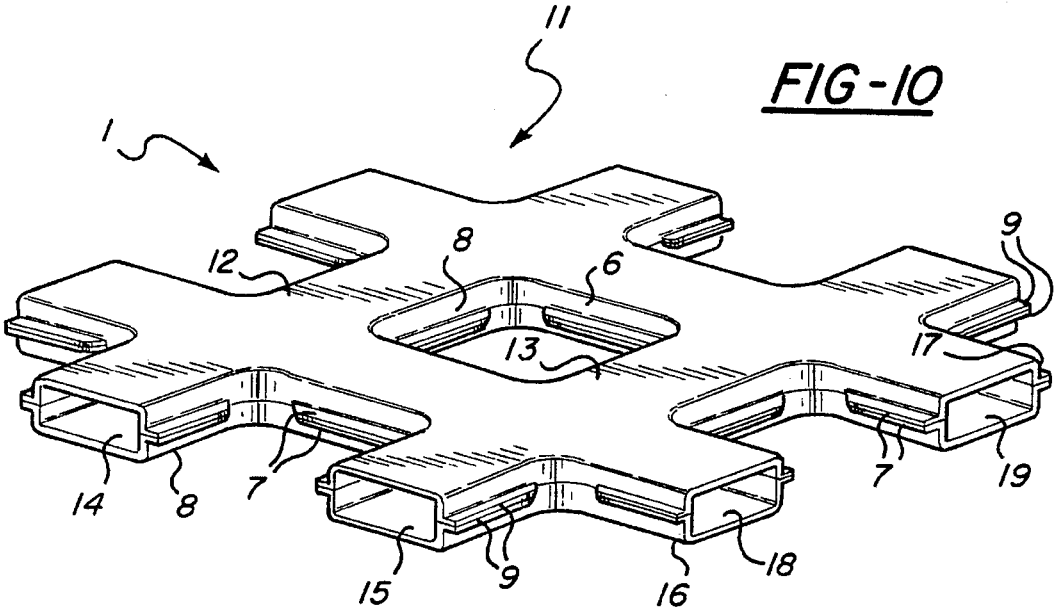

FIGS. 4 and 5 are enlarged sectional views taken on the lines 4—4 and 5—5, respectively, of FIG. 3;

FIG. 6 is a plan view showing a further stage of development of the workpiece;

FIGS. 7 and 8 are enlarged sectional views taken on the lines 7—7 and 8—8, respectively, of FIG. 6;

FIG. 9 is an enlarged perspective view showing two of the formed workpieces in spaced apart, overlying relation preparatory to being joined to one another;

FIG. 10 is a perspective view showing a completed rack base; and

Figure 11:
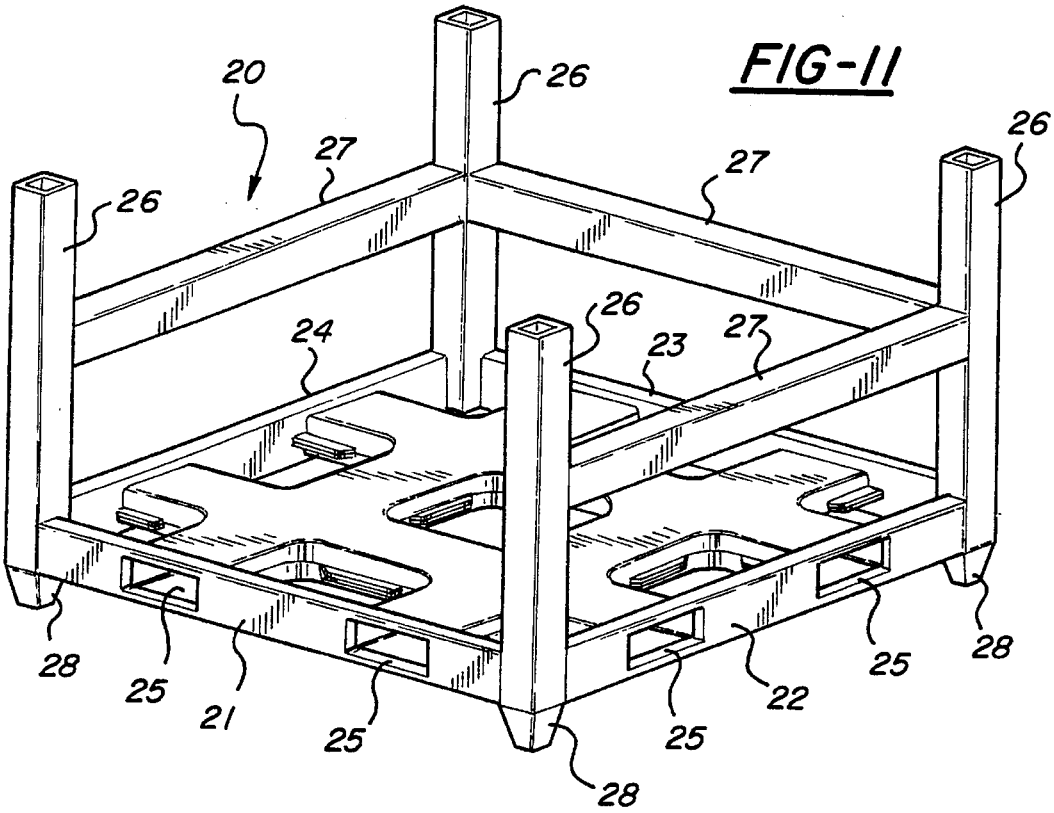

FIG. 11 is a perspective view showing the base provided with a typical superstructure to form a rack.

THE PREFERRED EMBODIMENT

Figure 1:
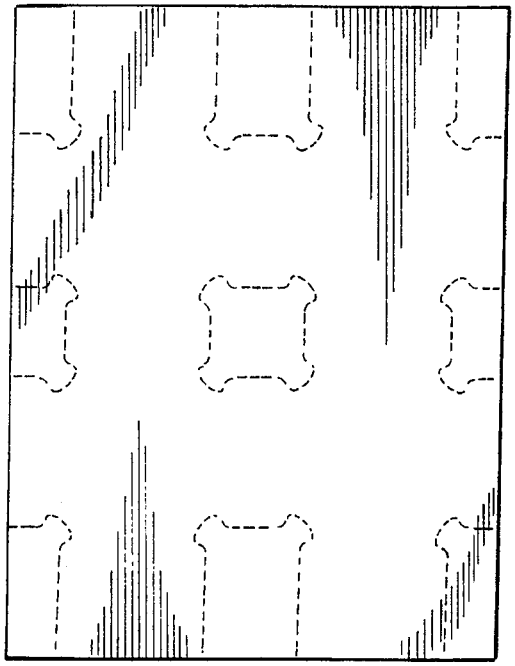
FIG. 1 is a plan view of a metal sheet indicated in dash lines how the sheet is to be stamped to form one blank.
Figure 2:
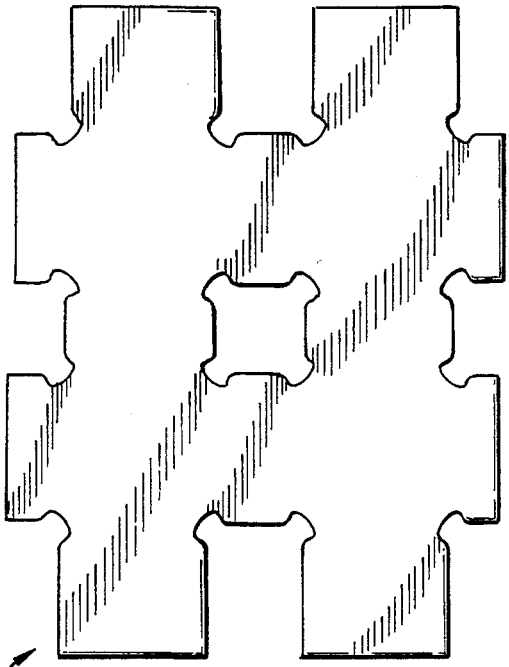
FIG. 2 is a plan view showing the blank formed from the stamping of the metal sheet.

A rack formed in accordance with the preferred embodiment of the invention is designated generally by the reference character 1 in FIG. 10 and is formed from two rectangular, uniform thickness steel sheets 2, one of which is shown in FIG. 1. The second sheet is identical to the sheet 2. The metal sheet 2 is adapted to be converted to the configuration shown in FIG. 2 by a stamping operation that is conventional. Following the stamping operation the sheet 2 is transformed into a metallic blank 3. The blank 3 then is subjected to a series of stamping operations to form a first pair of planar, parallel members 4 and a second pair of planar, parallel members 5, the upper surfaces of the members 4 and 5 intersecting one another and being coplanar.

The first stamping operation provides downwardly inclined flanges 6 at opposite sides of each of the members 4 and arcuate recesses at the intersection of each member 4 and 5. The flanges 6 terminate in lips 7 which extend at right angles to the free edges of the flanges 6. Similar flanges 8 are formed on opposite sides of each member 5 and each flange includes a lip 9 which extends at right angles to the free end of each flange.

The partially formed blank 3 shown in FIG. 3 then is subjected to a further stamping operation which causes the flanges 6 to depend vertically from the member 4 and the flanges 8 to depend vertically from the members 5. This will cause the lips 7 and 9 to assume a position parallel to the members 4 and 5, respectively, as is shown in FIGS. 7 and 8. Each blank 3 thus forms a workpiece 10 having the tic-tac-toe form shown in FIGS. 6 and 9.

Following the formation of two workpieces 10, they are arranged in overlying relation with the flanges 6 and 8 confronting one another as is shown in FIG. 9. When properly oriented, the flanges 6 of each workpiece 10 are vertically aligned and confront one another and the flanges 8 of each workpiece similarly are vertically aligned and confront each other. The lips 7 of the upper workpiece 10 confront and bear upon the lips 7 of the lower workpiece and the lips 9 of the upper workpiece confront and bear upon the lips 9 of the lower workpiece. The confronting flanges and lips then may be welded to one another to form the one-piece base 1 comprising a hollow body 11 having parallel, spaced members 12 and 13 which form unobstructed tunnels 14 and 15, respectively, and parallel, spaced apart members 16 and 17 which form unobstructed tunnels 18 and 19. The members 12, 13 and 16, 17 form a hollow tic-tac-toe shaped base, and the pairs of tunnels 14, 15 and 18, 19 are spaced laterally from one another and are of such height as freely to accommodate the forks of a forklift truck.

The upper and lower surfaces of the base 1 are flat and parallel to one another.

The base 1 may be joined to any one of a number of different kinds of structural frame members so as to form a rack. One such rack is shown at 20 in FIG. 11 and comprises a plurality of horizontal further frame members 21, 22, 23, and 24 welded to the ends of the tunnel-forming members so as to form a quadrangular frame at the perimeter of the base. If the frame members 21–24 are secured to the ends of the tunnel-forming members, as shown, the frame members should have openings 25 formed therein through which forks of a forklift truck may pass, and such openings should register with the respective tunnels. The frame members 21–24 also are secured to one another via upstanding, hollow legs 26 and such legs may be spanned by and secured to additional, vertically spaced frame members 27. Preferably, the lower end of each leg 26 is provided with a tapered foot 28 which may be accommodated in the open, upper end of the legs of another rack so as to facilitate vertical stacking of racks.

It is not necessary that the lips 7 and 9 be provided. Instead, such lips can be eliminated and the confronting edges of the vertically aligned flanges 6 and 8 of a pair of workpieces 10 welded to one another. The presence of the lips 7 and 9, however, provides a greater surface area for welding and also reinforces the respective tunnel members from the sides.

A rack base constructed in accordance with the invention involves considerably fewer operations than are required to construct such a base in a conventional manner. Accordingly, bases constructed in accordance with the invention can be produced rapidly and at relatively low cost.

A further advantage of a base constructed in accordance with the invention is that only two separate workpieces are required in the formation of such base. This enables a considerably more rigid base to be formed than is possible when a base is composed of four or more individual pieces that must be aligned and welded to one another. Further, since no part of either workpiece forming the base disclosed herein has to be cut, the structural integrity of such base is extremely high.

The disclosed embodiment is representative of the preferred form of the invention, but is intended to be illustrative rather than definitive thereof. The invention is defined in the claims.

I claim:

1. A base construction comprising a pair of overlying frame members each of which is formed from a single, flat blank each of which has a first pair of spaced apart, parallel, substantially uniform length limbs and a second pair of spaced apart, parallel, substantially uniform length limbs extending at right angles to the first pair of limbs, each of said limbs having free ends and on its opposite sides a right angular flange, the flanges of the limbs of one of said frame members confronting and being secured to the flanges of the limbs of the other of said frame members whereby said frame members together form a hollow body of tic-tac-toe configuration and the overlying limbs form tunnels.

2. The construction according to claim 1 wherein the spacing and height of said tunnels enable forks of a forklift truck to be accommodated in any adjacent, parallel pair of said tunnels.

3. The construction according to claim 1 wherein each flange of each of said limbs terminates in a lip, the lips of the flanges of each of said members overlying the lips of the flanges of the other of said members.

4. The construction according to claim 3 wherein the lips of each of said flanges extend at right angles to their respective flanges.

5. The construction according to claim 3 wherein the lips of each of said flanges extend in a direction outwardly of the associated tunnel.

6. The construction according to claim 3 wherein the lips of overlying limbs are secured to one another.

7. The construction according to claim 1 including a further frame member secured between its ends to the free ends of each of said limbs and secured at their opposite ends to one another to form a quadrangular frame at the perimeter of said base construction.

8. The construction according to claim 7 wherein each of said further frame members overlies the free ends of an adjacent pair of said limbs and wherein each of said further frame members is provided with openings in register with the tunnels formed by the associated limbs.

9. The construction according to claim 1 wherein said frame members have flat surfaces spaced from one another by said flanges.

10. A base construction comprising a pair of overlying frame members each of which is of tic-tac-toe configuration having a first pair of spaced, parallel limbs, and a second pair of spaced, parallel limbs extending transversely of and intersecting the limbs of said first pair of limbs, each of said frame members having right angular flanges extending in the same direction from one surface of said frame member, said frame members being so arranged that the flanges of one of said frame members confront and overlie the flanges of the other of said frame members, and means securing the flanges of said members to one another to space said surfaces from one another and enable the overlying limbs of each of said frame members to form a tunnel that is unobstructed throughout its length.

11. The construction according to claim 10 wherein said surface of each of said frame members is flat.

12. The construction according to claim 10 wherein said confronting flanges are welded to one another.

13. The construction according to claim 10 wherein each of said confronting flanges terminates in a right angular lip, the lips of confronting flanges overlying one another and extending outward of the associated tunnel.

14. The construction according to claim 13 wherein the overlying lips are secured to one another.

15. A method of producing a forkliftable rack base comprising forming two workpieces each of which has a first pair of parallel, spaced apart limbs and a second pair of parallel, spaced apart limbs; forming on opposite sides of each of said limbs a right angular flange, all of said flanges extending in the same direction from one surface of the associated workpiece; arranging said workpieces in overlying relation with the flanges of one of said workpieces confronting the flanges of the other of said workpieces; and securing the confronting flanges to one another to form a hollow body of tic-tac-toe configuration having a first pair of parallel, spaced apart tunnels and a second pair of parallel, spaced apart tunnels at right angles to and intersecting the tunnels of said first pair of tunnels, the tunnels of each pair of tunnels being of such size and so spaced as to accommodate spaced apart forks of a forklift truck.

16. The method according to claim 15 wherein the confronting flanges are secured by welding.

17. The method according to claim 15 including forming right angular lips on each of said flanges, the lips on the flanges of each of said workpieces overlying and confronting one another.

18. The method according to claim 17 wherein the lips on the flanges of each of said workpieces extend outwardly of the associated tunnel.

19. The method according to claim 17 including securing the confronting lips to one another.

* * * * *